US009199156B2

(12) United States Patent
Bjertnaes

(10) Patent No.: US 9,199,156 B2
(45) Date of Patent: Dec. 1, 2015

(54) SKI HAVING A MOUNTING AID FOR A BINDING, PROCESS FOR THE MANUFACTURE OF SUCH A SKI, AND CORRESPONDING MOUNTING AID

(71) Applicant: Madshus AS, Biri (NO)

(72) Inventor: Gunnar Bjertnaes, Lillehammer (NO)

(73) Assignee: Madshus AS, Biri (NO)

( * ) Notice: Subject to any disclaimer, the term of this patent is extended or adjusted under 35 U.S.C. 154(b) by 0 days.

(21) Appl. No.: 13/895,703

(22) Filed: May 16, 2013

(65) Prior Publication Data

US 2013/0249192 A1 Sep. 26, 2013

Related U.S. Application Data

(60) Continuation of application No. 13/187,450, filed on Jul. 20, 2011, now Pat. No. 8,460,505, which is a division of application No. 10/535,619, filed as application No. PCT/IB03/05332 on Nov. 19, 2003, now Pat. No. 7,984,921.

(30) Foreign Application Priority Data

Nov. 21, 2002 (DE) ..... 102 54 471

(51) Int. Cl.

| | |
|---|---|
| ***A63C 5/14*** | (2006.01) |
| ***A63C 9/00*** | (2012.01) |
| ***A63C 5/12*** | (2006.01) |

(52) U.S. Cl.

CPC . *A63C 9/00* (2013.01); *A63C 5/128* (2013.01); *A63C 9/003* (2013.01); *Y10T 156/10* (2015.01)

(58) Field of Classification Search

USPC ..... 280/607, 610

See application file for complete search history.

(56) References Cited

U.S. PATENT DOCUMENTS

| | | | |
|---|---|---|---|
| 1,964,103 | A | 6/1934 | Attenhoffer |
| 2,094,667 | A | 10/1937 | Parish |
| 3,137,014 | A | 6/1964 | Meucci |
| 3,797,839 | A | 3/1974 | Smolka et al. |
| 3,797,844 | A | 3/1974 | Smolka et al. |
| 3,894,745 | A | 7/1975 | Heim et al. |
| 3,950,001 | A | 4/1976 | Weigl |

(Continued)

FOREIGN PATENT DOCUMENTS

| | | |
|---|---|---|
| AT | 327066 | 1/1976 |
| AT | 354306 B | 1/1980 |

(Continued)

OTHER PUBLICATIONS

Office Action dated Nov. 15, 2013 for Norwegian Patent Application No. 20074046.

(Continued)

*Primary Examiner* — Jeffrey J Restifo

(74) *Attorney, Agent, or Firm* — Knobbe Martens Olson & Bear LLP

(57) ABSTRACT

Ski or similar device for sliding on snow having a mounting aid for a binding (28) or for components thereof, which aid is mounted on the top face (32) of the ski and is especially in the form of a binding plate (10), wherein the mounting aid or binding plate (10) is durably connected to the top face (32) of the ski in such a manner that ski (23) and mounting aid or binding plate (10) form an integral constructional unit in terms of the mechanical properties.

20 Claims, 2 Drawing Sheets

(56) References Cited

U.S. PATENT DOCUMENTS

| | | | | | |
|---|---|---|---|---|---|
| 3,966,218 | A | | 6/1976 | Beyl | |
| 4,071,264 | A | | 1/1978 | Legrand et al. | |
| 4,093,268 | A | | 6/1978 | Sampson et al. | |
| 4,186,500 | A | | 2/1980 | Salzman | |
| 4,199,645 | A | | 4/1980 | Schwarz | |
| 4,266,806 | A | | 5/1981 | Weigl et al. | |
| 4,273,355 | A | | 6/1981 | Storandt | |
| 4,310,170 | A | | 1/1982 | Linecker | |
| 4,322,090 | A | | 3/1982 | Loughney | |
| 4,522,424 | A | | 6/1985 | Luitz et al. | |
| 4,524,990 | A | | 6/1985 | Svoboda et al. | |
| 4,571,858 | A | | 2/1986 | Faulin | |
| 4,586,727 | A | | 5/1986 | Andrieu et al. | |
| 4,639,009 | A | | 1/1987 | Meatto et al. | |
| 4,652,006 | A | | 3/1987 | Desoutter | |
| 4,722,613 | A | | 2/1988 | Jungkind | |
| 4,772,041 | A | | 9/1988 | Klosterman | |
| 4,887,833 | A | | 12/1989 | Bailey | |
| 4,949,996 | A | * | 8/1990 | McNally | 280/816 |
| 4,955,633 | A | | 9/1990 | Stritzl et al. | |
| 4,974,867 | A | | 12/1990 | Rullier et al. | |
| 5,026,086 | A | * | 6/1991 | Guers et al. | 280/607 |
| 5,088,756 | A | | 2/1992 | Hue et al. | |
| 5,114,172 | A | | 5/1992 | Rousset et al. | |
| 5,116,073 | A | | 5/1992 | Goud | |
| 5,125,680 | A | | 6/1992 | Bejean et al. | |
| 5,143,395 | A | | 9/1992 | Mayr | |
| 5,190,309 | A | | 3/1993 | Spitaler et al. | |
| 5,199,734 | A | * | 4/1993 | Mayr | 280/602 |
| 5,207,445 | A | | 5/1993 | Hoelzl | |
| 5,211,418 | A | | 5/1993 | Scherubl | |
| 5,221,104 | A | | 6/1993 | Bejean et al. | |
| 5,232,241 | A | | 8/1993 | Knott et al. | |
| D345,454 | S | | 3/1994 | Hauglin | |
| 5,333,889 | A | | 8/1994 | Piegay et al. | |
| 5,333,890 | A | | 8/1994 | Bejean | |
| 5,338,051 | A | * | 8/1994 | Szafranski et al. | 280/607 |
| 5,344,178 | A | | 9/1994 | Rohrmoser | |
| 5,344,179 | A | | 9/1994 | Fritschi et al. | |
| 5,356,169 | A | | 10/1994 | Hue et al. | |
| 5,372,370 | A | | 12/1994 | Rohrmoser | |
| 5,431,427 | A | | 7/1995 | Pieber et al. | |
| 5,480,175 | A | | 1/1996 | Astier et al. | |
| 5,484,149 | A | | 1/1996 | Lee | |
| 5,498,017 | A | | 3/1996 | Rohrmoser | |
| 5,499,421 | A | | 3/1996 | Brice | |
| 5,524,919 | A | | 6/1996 | Sedlmair | |
| 5,597,170 | A | | 1/1997 | Le Masson et al. | |
| 5,671,941 | A | | 9/1997 | Girard | |
| 5,732,968 | A | | 3/1998 | Wladar et al. | |
| 5,765,854 | A | | 6/1998 | Moore et al. | |
| 5,785,342 | A | | 7/1998 | Bronson | |
| 5,829,776 | A | * | 11/1998 | Deville et al. | 280/602 |
| 5,836,604 | A | | 11/1998 | Piegay | |
| 5,897,127 | A | | 4/1999 | Hauglin | |
| 5,899,006 | A | | 5/1999 | Donnadieu | |
| 5,919,084 | A | | 7/1999 | Powell et al. | |
| 5,924,719 | A | | 7/1999 | Girard | |
| 5,944,336 | A | | 8/1999 | Fagot | |
| 5,944,337 | A | | 8/1999 | Girard et al. | |
| 6,017,050 | A | | 1/2000 | Girard | |
| 6,056,310 | A | * | 5/2000 | Hangl | 280/607 |
| 6,065,895 | A | | 5/2000 | Lehner et al. | |
| 6,092,829 | A | | 7/2000 | Mercier | |
| 6,193,262 | B1 | | 2/2001 | Silva | |
| 6,209,903 | B1 | | 4/2001 | Girard | |
| 6,216,366 | B1 | | 4/2001 | Donnadieu | |
| 6,244,616 | B1 | | 6/2001 | Arduin et al. | |
| 6,289,610 | B1 | | 9/2001 | Girard et al. | |
| 6,315,318 | B1 | | 11/2001 | Caron et al. | |
| 6,374,517 | B2 | | 4/2002 | Girard et al. | |
| 6,390,493 | B1 | | 5/2002 | Hauglin | |
| 6,402,184 | B1 | | 6/2002 | Hauglin | |
| 6,450,510 | B1 | | 9/2002 | Liu | |
| 6,471,235 | B1 | | 10/2002 | Luitz et al. | |
| 6,499,761 | B1 | | 12/2002 | Quellais | |
| 6,547,261 | B2 | | 4/2003 | Gorza et al. | |
| 6,588,791 | B1 | | 7/2003 | Hom | |
| 6,612,592 | B1 | | 9/2003 | Soo | |
| 6,619,688 | B2 | | 9/2003 | Billon et al. | |
| 6,631,918 | B2 | | 10/2003 | Silva | |
| 6,670,018 | B2 | | 12/2003 | Fujita et al. | |
| D488,294 | S | | 4/2004 | Lancon | |
| 6,783,145 | B2 | | 8/2004 | Deborde et al. | |
| 6,814,367 | B2 | | 11/2004 | Mercier et al. | |
| 6,824,158 | B1 | | 11/2004 | Keller et al. | |
| 6,848,703 | B2 | | 2/2005 | Godde et al. | |
| 6,896,284 | B2 | | 5/2005 | Kruajitch | |
| 6,923,464 | B2 | | 8/2005 | Noviant | |
| 6,935,273 | B2 | | 8/2005 | Throndsen et al. | |
| 7,036,842 | B2 | | 5/2006 | Krumbeck et al. | |
| 7,055,846 | B2 | | 6/2006 | Restani | |
| 7,077,419 | B2 | | 7/2006 | Cuzzit et al. | |
| 7,207,591 | B2 | | 4/2007 | Riedel et al. | |
| 7,264,263 | B2 | | 9/2007 | Riedel et al. | |
| 7,828,303 | B2 | * | 11/2010 | Girard et al. | 280/11.3 |
| 7,984,921 | B2 | * | 7/2011 | Bjertnaes | 280/607 |
| 8,448,974 | B2 | * | 5/2013 | Huber et al. | 280/607 |
| 8,460,505 | B2 | * | 6/2013 | Bjertnaes | 156/314 |
| 2002/0105167 | A1 | | 8/2002 | Mercier et al. | |
| 2003/0155742 | A1 | | 8/2003 | Riedel et al. | |
| 2004/0164519 | A1 | | 8/2004 | Quellais et al. | |
| 2004/0207177 | A1 | | 10/2004 | Riedel et al. | |
| 2004/0262886 | A1 | | 12/2004 | Girard | |
| 2006/0145452 | A1 | * | 7/2006 | Bjertnaes | 280/607 |
| 2008/0203703 | A1 | * | 8/2008 | Hauglin et al. | 280/607 |

FOREIGN PATENT DOCUMENTS

| | | | |
|---|---|---|---|
| CH | 557154 | | 12/1974 |
| DE | 1929885 | | 12/1965 |
| DE | 24 18 577 | A | 10/1975 |
| DE | 26 45 007 | | 10/1976 |
| DE | 27 14 853 | A | 10/1978 |
| DE | 27 28 747 | A | 1/1979 |
| DE | 3113942 | A1 | 10/1982 |
| DE | 3222132 | A1 | 12/1983 |
| DE | 3527219 | | 2/1986 |
| DE | 37 85 420 | T2 | 6/1987 |
| DE | 38385569 | | 6/1989 |
| DE | 3924939 | A1 | 5/1990 |
| DE | 3924899 | | 7/1990 |
| DE | 69100491 | T3 | 10/1991 |
| DE | 4229039 | | 4/1993 |
| DE | 93 20 530 | | 10/1994 |
| DE | 195 17 791 | A1 | 5/1995 |
| DE | 19753451 | A1 | 6/1999 |
| DE | 200 07 032 | U1 | 9/2000 |
| DE | 102004023832 | | 11/2002 |
| DE | 10124893 | | 11/2003 |
| DE | 102004018296 | A1 | 2/2005 |
| DE | 10319675 | | 6/2005 |
| DE | 10 2004 030 718 | A1 | 1/2006 |
| EP | 0029206 | A | 5/1981 |
| EP | 0506064 | A1 | 9/1992 |
| EP | 0346414 | | 10/1992 |
| EP | 0787440 | | 8/1997 |
| EP | 0 820 790 | A | 1/1998 |
| EP | 0878218 | A2 | 11/1998 |
| EP | 0 908 204 | A2 | 4/1999 |
| EP | 0 951 926 | A | 10/1999 |
| EP | 1240925 | A1 | 9/2002 |
| FR | 2569119 | | 2/1986 |
| FR | 2 556 188 | A1 | 12/1993 |
| FR | 2 741 543 | | 5/1997 |
| FR | 2 742 060 | | 6/1997 |
| FR | 2 803 178 | A1 | 12/1999 |
| NO | 319592 | | 7/2003 |
| WO | WO 88/04563 | | 6/1988 |
| WO | WO 89/00067 | | 1/1989 |
| WO | WO 93/16769 | | 9/1993 |
| WO | WO 96/23558 | | 8/1996 |
| WO | WO 01/66204 | A | 9/2001 |
| WO | WO 02/49728 | A1 | 6/2002 |

(56) References Cited

FOREIGN PATENT DOCUMENTS

| | | | |
|---|---|---|---|
| WO | WO 03/002217 | A2 | 1/2003 |
| WO | WO 03/101555 | | 12/2003 |
| WO | WO 2004/045728 | A | 6/2004 |

OTHER PUBLICATIONS

Front and back pages, and pp. 1, 2, 21, 165, 404-407, 590, 591, 622 of "Kleben Grundlagen, Technologie, Anwendungen", 3rd ed., 1997, Springer Verlag cited in opposition against EP 1562683.
Opposition filed by Fisher Sports GmbH on Dec. 23, 2009 against EP 1846116 B1, which corresponds to U.S. Appl. No. 11/813,610.
Opposition filed by Fisher Sports GmbH on Oct. 6, 2010 filed against European Patent Application No. EP 1562683 B1, which corresponds to U.S. Appl. No. 10/535,619.
Data Sheet Araldit AW 106, Härter HV 953, published Mar. 1998, 8 pages cited in opposition against EP1562682.
Domininghaus, Hans, "Die Kunststoffe and ihre Eigenschaften" VDI Verlag, 1986, cited in opposition against European Patent EP 1846116.
English translation of Opposition Statement filed Dec. 23, 2009 by Opposer Fischer Sports GmbH against European Patent EP 1846116.
English translation of Opposition Statement filed Oct. 6, 2010 by Fischer Sports GmbH against European Patent EP 1562683.
Extended Search Report dated Jan. 25, 2010 for European Application No. 09177504.9, filed Nov. 19, 2003.
Extract from "Bauelemente der Feinmechanik" [Components of Precision Mechanics], VEB Verlag Technik, 1959 cited in opposition against EP 1562683.
Interlocutory decision dated Aug. 10, 2012 in opposition against EP 1562683.
International Search Report and Written Opinion dated Aug. 14, 2007 for PCT/IB2005/000032, which corresponds to U.S. Appl. No. 11/813,610, filed Aug. 21, 2007.
International Search Report dated Aug. 3, 2004 for PCT/IB2003/005332.
Office Action mailed Mar. 21, 2012 in U.S. Appl. No. 11/813,610, filed Aug. 21, 2007.
Office Action mailed Mar. 25, 2010 in U.S. Appl. No. 11/813,610, filed Aug. 21, 2007.
Office Action mailed Oct. 1, 2010 in U.S. Appl. No. 10/535,619, filed Jan. 4, 2006.
Response filed by Patent Owner on Aug. 6, 2010 in Opposition Proceedings against European Patent No. 1846116.
Appeal Brief filed by Applicant on Jun. 25, 2013 in U.S. Appl. No. 11/813,610, filed Aug. 21, 2007; 15 pages.
Office Action dated Jul. 30, 3013 in U.S. Appl. No. 11/813,610, filed Aug. 21, 2007; 4 pages.
Schultes, Hermann, "The Alpine Ski," Olin Ski Co., 1980, Chapter 2.9.4 "Modern Adhesives for the Ski Industry," Cover page and pp. 99-105; cited in opposition proceedings against EP 1562683.
Office Action dated Dec. 10, 2013 for U.S. Appl. No. 11/813,610.

* cited by examiner

SKI HAVING A MOUNTING AID FOR A BINDING, PROCESS FOR THE MANUFACTURE OF SUCH A SKI, AND CORRESPONDING MOUNTING AID

CROSS-REFERENCE TO RELATED APPLICATIONS

This application is a continuation of and claims priority to U.S. patent application Ser. No. 13/187,450, filed on Jun. 20, 2011, which is a divisional of U.S. patent application Ser. No. 10/535,619, filed on Jan. 4, 2006, now U.S. Pat. No. 7,984,921, which is a National Phase entry of PCT/IB2003/005332, filed on Nov. 19, 2003. The above applications are hereby incorporated by reference in their entireties.

BACKGROUND OF THE INVENTION

1. Field of the Invention

The invention relates to a ski or similar device for sliding on snow having a mounting aid for a binding or for components thereof, which aid is mounted on the top face of the ski and is especially in the form of a binding plate. The present invention relates also to a process for the manufacture of such a ski and to a corresponding mounting aid as such.

2. Description of the Related Art

The arrangement of mounting aids in the form of so-called binding plates on the top face of a ski is generally known. The binding plate is fastened to the top face of the ski by means of screws. In order for the screws to have sufficient hold in the ski or ski body, the ski body needs to be formed with separate reinforcement in the region in which the binding plate is fastened. As a rule, this is achieved by the integration of a solid wood core or of a separate mounting plate made of plastics or metal into the binding region of a ski or snowboard. Clearly, such reinforcing inserts have an appreciable influence on the flexural strength and torsional rigidity of the ski, on the one hand, and on the flexibility of the ski, on the other hand. In addition, the weight of the ski is increased by a not inconsiderable amount by the conventional reinforcing inserts. It must also be borne in mind, in addition, that the binding plates fastened by means of screws are so fastened, at least at one end, that they are displaceable in the longitudinal direction relative to the ski. For that purpose, the holes provided at that end of the binding plate for the fastening screws are formed as slots. The mentioned relative movability between binding plate and ski is necessary especially because the conventional binding plates usually consist of metal, especially aluminium, and thus exhibit mechanical properties that are clearly different from the mechanical properties of the ski. The mentioned relative movability between binding plate and ski in the longitudinal direction of the ski naturally also influences the running performance of the ski to a not inconsiderable extent, so that the conventional constructions are distinguished by a number of disadvantages in terms of manufacturing technology and skiing technology, which the invention seeks to overcome. In respect of prior art, reference shall be made purely by way of example to US 2002/0105167.

SUMMARY OF THE INVENTION

The problem underlying the present invention is accordingly to create a ski of the kind mentioned at the outset that, from the point of view of the manufacturer, can be provided in a simple manner with a mounting aid, and that is distinguished especially by the fact that its running performance is not influenced, or is influenced only to an insignificant extent, by the mounting aid. A further problem of the present invention is to provide a process for the manufacture of such a ski, and to provide a corresponding mounting aid.

This problem is solved, in respect of a ski, by the characterizing features of advantageous details of the construction according to the invention being described in claims herein.

The core of the present invention resides in the fact that the mounting aid, especially in the form of a binding plate, is durably connected to the top face of the ski and in such a manner that ski and mounting aid form an integral constructional unit in terms of the mechanical properties, such as thermal expansion, tensile strength, flexural strength and torsional rigidity etc. Ski and mounting aid are to be connected to one another as though to constitute a one-piece constructional unit. For that purpose, the mounting aid is preferably welded or bonded, especially over the whole surface, to the top face of the ski. In terms of process technology, the application of the mounting aid can either take place after the ski has been produced or can be effected together with the top layer of the ski. The latter method can be used especially when the mounting aid is to be welded to the top layer of the ski, which defines the top face of the ski. The welding technique is suitable especially when the mounting aid consists of plastics material or of a plastics laminate.

Preferably, the mounting aid comprises a longitudinal guide with undercut for the longitudinal positioning and fixing of the binding or of binding components. Fixing is effected preferably by means of set screws, which are associated with the binding or the binding components and cooperate with the mounting aid. Screw-fixing the binding or binding components in the ski is no longer necessary. Fastening screws act on the mounting aid only. Separate reinforcement of the ski in the binding region is accordingly also no longer necessary. It is naturally also no longer necessary for tapped holes to be formed in the ski body through the top face of the ski in order for the binding or binding components to be fastened to the ski. Such a procedure is usually not carried out until the skis are sold, and accordingly necessitates separate devices, which are expensive to produce and naturally also expensive to operate, requiring skilled service personnel. All of those shortcomings can be overcome by a ski-integrated mounting aid in which the mounting aid is preferably so formed that the binding, or components of the binding, are displaceable, positionable and fixable in the longitudinal direction without any problem.

In a preferred embodiment, the mounting aid is in the form of a plate which is either T-shaped or U-shaped in cross-section, wherein, in the first case, the crosspiece extends spaced from, and parallel to, the top face of the ski, with the result that it is possible for the binding housing to engage beneath the two lateral longitudinal edges of the binding plate so formed. In the latter embodiment, with the U-shaped binding plate, the two upwardly projecting arms thereof are each drawn inwards in the shape of a hook, with the result that a longitudinal guide rail is formed having longitudinal edges undercut on the inside which engage over a binding housing.

After appropriate positioning, the binding or binding components are fixed to the binding plate using set screws, which act vertically on the binding plate.

The mounting aid or binding plate can be of one-part or alternatively two-part construction. In the case of a one-part arrangement, a front and a rear portion of the binding plate are connected to one another by a connection piece or similar connecting element. The connecting element may be of narrower form and also thinner wall thickness compared with the front and rear portions. It is especially of such dimensions that it holds together the front and rear portions of the binding plate without interfering with the flexibility of the ski.

Another possibility is for the connecting element to be displaceable in the longitudinal direction of the ski relative to the front and/or the rear portion of the binding plate. Such a construction is possible when the connecting element is not joined fast, especially bonded, to the top face of the ski.

In the region of the front and/or in the region of the rear portion of the binding plate, arrangements may be provided, for example in the form of snap-in lugs or detent apertures, for the longitudinal positioning and fixing of the binding.

The mounting aid preferably consists of a plastics material, a wood laminate, or a plastics/wood and/or plastics/metal laminate. It is crucial for the mounting aid to have approximately the same properties as the associated portion of the ski in terms of flexibility and torsion and also thermal expansion.

Attention is also drawn to the fact that, when the mounting aid is bonded, the adhesive layer is extremely thin. Its thickness should be a maximum of from 5 to 10% of the thickness of the mounting plate. The adhesive layer should thus not define a damping, volume. The bonding or welding, especially bonding or welding of the whole surface, provided in accordance with the invention, furthermore ensures that there are no stress points between mounting aid and ski that may result in the ski being overloaded to breaking point.

The mounting aid preferably also has tapped holes for fixing a binding or binding components. The mounting aid may also have, extending transversely to the longitudinal direction of the ski, snap-in ribs which cooperate with corresponding clamping wedges on the binding or binding components.

BRIEF DESCRIPTION OF THE DRAWINGS

In the following, a preferred embodiment of a ski formed in accordance with the invention, and of a corresponding binding plate, is explained in detail with reference to the accompanying drawings in which.

DETAILED DESCRIPTION OF PREFERRED EMBODIMENTS

Figure 1:
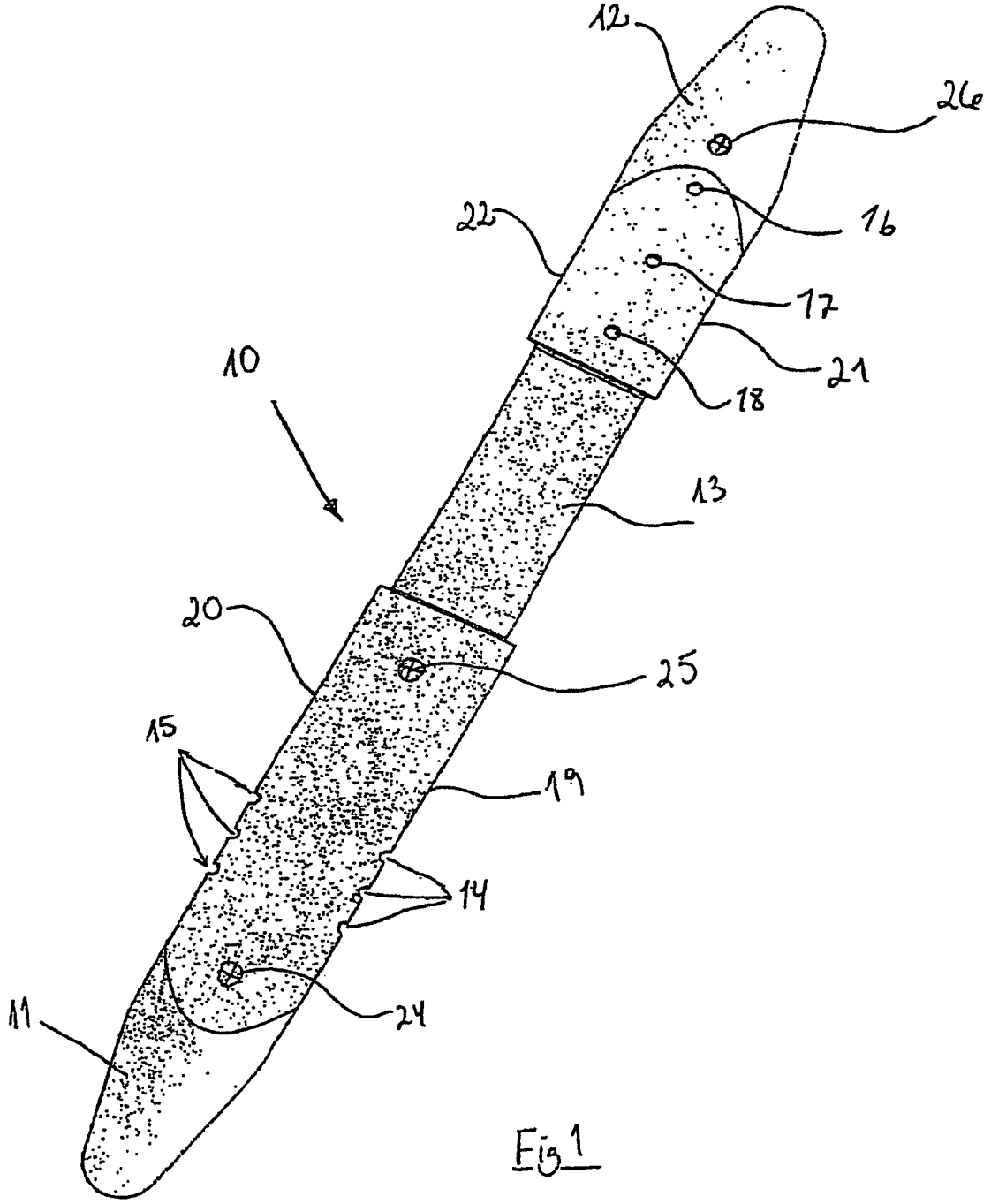
FIG. 1 is a plan view of a mounting aid, namely a binding plate, provided in accordance with the invention.
Figure 2:
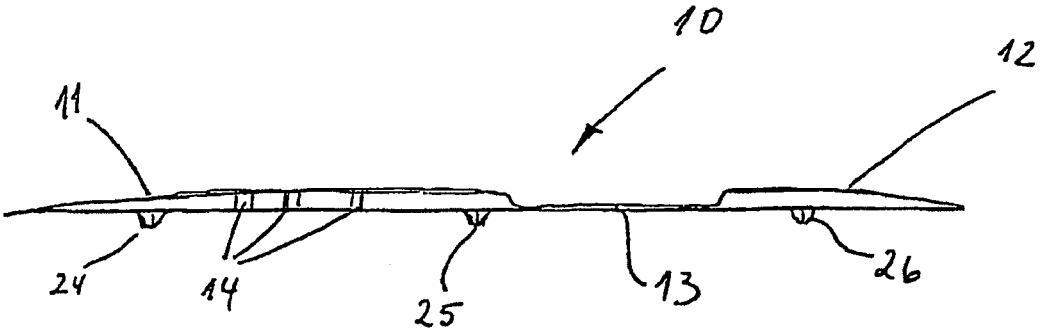
FIG. 2 is a lateral view of the binding plate according to FIG. 1.
Figure 3:
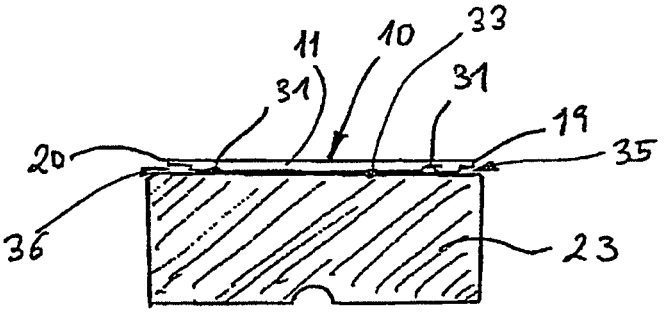
FIG. 3 is a cross-section of a ski to which a binding plate according to FIGS. 1 and 2 has been bonded.
Figure 4:
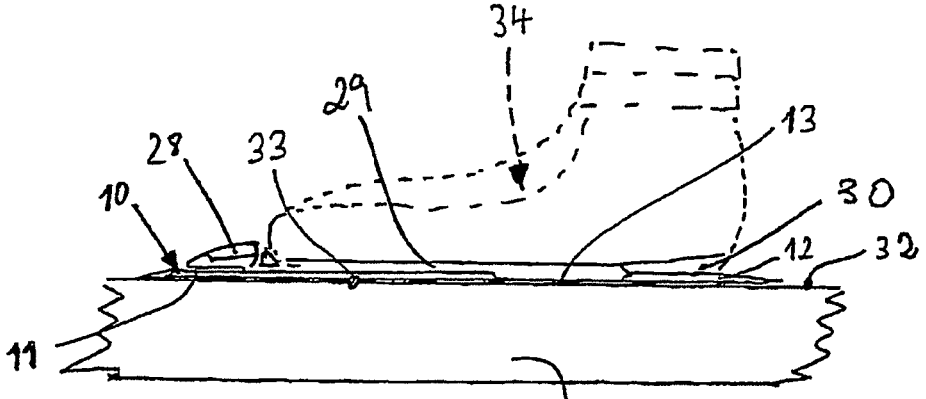
FIG. 4 is a lateral view of a ski, binding plate, cross-country binding and boot.

The embodiment of a mounting aid, in the form of a binding plate 10, shown in plan view in FIG. 1 consists of a front portion 11, a rear portion 12 and a central connecting portion 13, which is narrower and is of smaller wall thickness than the front and rear portions (see FIG. 2). The three portions are connected to one another in one piece and consist preferably of a plastics material that is resistant to weathering which, in the arrangement and dimensions shown, imparts to the binding plate mechanical properties that correspond to those of the ski in the central binding portion. In FIGS. 3 and 4, the binding portion of the ski associated with the binding plate 10 is indicated by the reference numeral 23.

At the underside, or at the side facing the top face 32 of the ski (FIG. 4), the binding plate 10 has downwardly projecting nipple-like or stud-like lugs 24, 25, 26, which correspond to complementary recesses formed in the top face 32 of the ski, which is not shown in detail. The lugs 24, 25, 26 are an additional safeguard for integral attachment of the binding plate 10 on the ski top-face 32. As already mentioned hereinabove, the binding plate 10 is to be welded or bonded, preferably over the whole surface, to the ski top-face 32. In FIGS. 3 and 4, the corresponding adhesive layer is indicated by the reference numeral 33. The adhesive layer 33 is of maximum thinness in order to ensure that the binding plate 10 is bound as closely as possible to the ski, i.e. its top face. The binding plate is to be connected, as it were, in one piece with the ski. In an extreme case it is even possible for the binding plate to be applied directly to the upper side of the ski core and encapsulated by the ski top-face layer. That technology can be used especially in connection with so-called "Schalenskis" ("dish" skis) in which the top face of the ski is drawn beyond the side cheeks almost to the running surface of the ski.

As can be seen clearly in FIG. 3, the front portion 11 of the binding plate 10 is formed with an approximately T-shaped cross-section, the crosspiece defining laterally protruding longitudinal edges 19, 20 along which a binding 28 (see FIG. 4) associated with the front portion 11 is movable back and forth, that is to say is positionable and is fixable by means of set screws not shown here. The binding 28 according to FIG. 4 is a cross-country binding, that is to say a binding for attaching the front end of a boot in such a manner that the heel or the boot heel is freely liftable. The rear portion 12 of the binding plate 10 is accordingly also formed solely for the attachment of a heel plate. For that purpose, the rear portion 12 has three tapped holes 16, 17, 18 spaced from one another in the longitudinal direction. This allows suitable positioning of a heel plate in the longitudinal direction of the ski irrespective of the boot size and the position of the boot heel 30 (FIG. 4).

Otherwise, the front portion 11 of the binding plate 10 is associated with the boot foresole 29 (FIG. 4). The connecting portion 13 is located in the region of the arch of the foot between foresole and boot heel. In FIG. 4, the associated boot is indicated by a broken line only, and has the reference numeral 34.

The rear portion 12 of the binding plate 10 is bounded laterally by longitudinal edges 21, 22, which may likewise protrude laterally beyond the basic body of the binding plate 10 in the same way as the longitudinal edges 19, 20 of the front portion 11 of the binding plate 10. When the rear portion 12 of the binding plate 10 serves only for the attachment of a heel plate, however, the mentioned formation of the longitudinal edges 21, 22 is not necessary. The longitudinal positioning of the heel plate is effected by appropriate association with respect to the tapped holes 16, 17, 18 arranged spaced from one another.

The front portion 11 of the binding plate 10 is thus formed as a longitudinal guide with undercut for the longitudinal positioning and fixing of a binding 28 or components thereof, wherein the undercuts 35, 36 are formed by the longitudinal side edges 19, 20 of the front portion 11 of the binding plate 10 protruding laterally beyond the basic body of the binding plate and the front portion 11 thereof, and spaced from the top face 32 of the ski, in the manner shown in FIG. 3. The housing of the binding 28 engages beneath the undercuts 35, 36.

Alternatively, the cross-section of the front and/or rear portion(s) 11, 12 of the binding plate 10 may be in the shape of a U, the two upwardly projecting arms then each being drawn inwards, or directed outwards, in order to define an undercut arrangement for the longitudinal positioning and fixing of a binding or of binding components.

In the embodiment shown here, there are formed at the two longitudinal edges 19, 20 of the front portion 11 of the binding plate 10 detent notches 14, 15, which cooperate with corresponding snap-in elements on the housing of the binding 28. By that means the binding 28 can be displaced stepwise in the longitudinal direction of the ski and preferably without using tools. The housing of the binding 28 comprises snap-in elements, especially snap-in pins, associated with the detent notches 14, 15, which elements are resiliently prebiased into the snap-in position. The resilient prebiasing is to be manually releasable by moving the snap-in pins, by means of a pressure-lever mechanism, against the action of the resilient prebiasing into an out-of-snapped-in position. The housing of the binding 28 can then be displaced in the longitudinal direction of the ski until the snap-in pins on the binding snap back into the desired detent notches 14, 15.

The detent notches 14, 15 can alternatively be formed at the top side of the front portion 11 of the binding plate 10. In any event, care must be taken that the snap-in connection is dimensioned to be strong enough for the binding 28 to remain securely positioned on the binding plate even in the event of relatively heavy loading.

An edge groove 31, which runs around the underside of the binding plate and into which excess adhesive can escape, may also be provided.

In principle, the binding plate can also be formed as an integral part of the top-face layer of the ski, that is to say for the top-face layer to be formed accordingly in the region of the binding. Such an embodiment would constitute the "most ski-integral" constructional unit. Care would in that case obviously have to be taken for the dimensions to be appropriate, in order to ensure the strength necessary for the binding to be held securely.

From the point of view of the manufacturer, either the binding plate 10 can be welded or bonded to the top face of the ski in a separate operating step after manufacture of the ski, or an alternative possibility is for the binding plate to be positioned on the ski body together with the ski top-face or the corresponding top layer after having previously been welded or bonded thereto. A suitable welding process is preferably laser welding. In principle, a so-called friction-welding process is also possible. This is governed ultimately also by the materials that are to be welded to one another. In any event, bonding between ski top-face and binding plate is also suitable for ensuring a durable connection between ski top-face and binding plate, that is to say one which is also resistant to weathering.

When the binding plate 10 is bonded, preferably first of all the side thereof facing the ski top-face is provided with an adhesive so that the binding plate can then be positioned inside a positioning device—where necessary after prior removal of a protective film from the adhesive side—on the top face of the ski and bonded fast thereto.

To increase the strength of adhesion between binding plate 10 and ski top-face, the ski top-face can be mechanically or chemically roughened at the adhesion site prior to bonding.

The core of the present invention thus lies in an essentially purely non-interlocking connection between mounting aid or binding plate (10) and ski or ski top-face (32). This non-interlocking connection can, if necessary, be supplemented by an interlocking connection, as illustrated by the above reference to the nipple-like or stud-like lugs 24, 25, 26.

All of the features disclosed in the application documents are claimed as being important to the invention, insofar as they are novel, individually or in combination, with respect to the prior art.

REFERENCE NUMERALS

10 binding plate (mounting aid)
11 front portion
12 rear portion
13 central connecting portion
14 detent notch
15 detent notch
16 tapped hole
17 tapped hole
18 tapped hole
19 longitudinal edge
20 longitudinal edge
21 longitudinal edge
22 longitudinal edge
23 binding portion of a ski
24 stud
25 stud
26 stud
28 binding
29 boot foresole
30 boot heel
31 edge groove
32 ski top-face
33 adhesive layer
34 boot
35 undercut
36 undercut

What is claimed is:

1. A device for sliding on snow comprising;

a ski having a ski top-face;

a binding plate comprising at least one lug extending downward from the binding plate and extending at least partially within at least one complementary recesses in the ski top face, the binding plate having an underside bonded to the ski top-face with a layer of adhesive covering the entire underside and without including screws; and an edge groove disposed around a perimeter of the underside configured to receive excess adhesive.

2. The device of claim 1, wherein the layer of adhesive has a maximum thickness of 5-10% of a thickness of the binding plate.

3. The device of claim 1, wherein the layer of adhesive does not define a damping volume in between the ski top-face and the underside of the binding plate.

4. The device of claim 1, wherein the ski and the binding plate form an integral constructional unit in respect of mechanical properties.

5. The device of claim 1, wherein the binding plate comprises two longitudinal edges defining undercuts between the binding plate and the ski top face, the undercuts configured to engage a binding or a binding component.

6. The device of claim 5, wherein the binding plate has a T-shaped cross section.

7. The device of claim 5, wherein the binding plate has a U-shaped cross section.

8. The device of claim 1, wherein the binding plate consists of a material selected from the group consisting of a plastics material, a wood laminate, a plastics/wood laminate, a plastics/metal laminate, and a plastics/wood laminate and a plastics/metal laminate.

9. The device of claim 1, wherein the biding plate comprises a flat, one-piece plate that is thin relative to the ski.

10. The device of claim 1, wherein the ski top-face is includes a roughened surface to increase the strength of adhesion between the binding plate and the ski top-face.

11. A device for sliding on snow comprising;

a ski having a ski top-face;

a binding plate having a top surface having a plurality of snap-in elements spaced apart in a longitudinal direction for snap-in position of a binding to the binding plate and an underside bonded to the ski top-face with a layer of adhesive covering the entire underside and without including screws; and an edge groove disposed around a perimeter of the underside configured to receive excess adhesive.

12. The device of claim 11, wherein the snap-in elements comprise detent notches configured to receive at least a portion of a binding or binding component.

13. The device of claim 11, wherein the layer of adhesive has a maximum thickness of 5-10% of a thickness of the binding plate.

14. The device of claim 11, wherein the layer of adhesive does not define a damping volume in between the ski top-face and the underside of the binding plate.

15. The device of claim 11, wherein the ski and the binding plate form an integral constructional unit in respect of mechanical properties.

16. The device of claim 11, wherein the binding plate comprises two longitudinal edges defining undercuts between the binding plate and the ski top face, the undercuts configured to engage a binding or a binding component.

17. The device of claim 16, wherein the binding plate has a T-shaped cross section.

18. The device of claim 16, wherein the binding plate has a U-shaped cross section.

19. The device of claim 11, wherein the biding plate comprises a flat, one-piece plate that is thin relative to the ski.

20. The device of claim 11, wherein the ski top-face is includes a roughened surface to increase the strength of adhesion between the binding plate and the ski top-face.

* * * * *